US005412965A

United States Patent [19]

Kuramoto

[11] Patent Number: 5,412,965

[45] Date of Patent: May 9, 1995

[54] METHOD OF DETERMINING THE OPTIMUM RATIOS OF ROLL ROTATION SPEEDS IN A COLD ROLL FORMING MILL

[75] Inventor: Ryusuke Kuramoto, Tondabayashi, Japan

[73] Assignee: Nakata Manufacturing Co., Ltd., Osaka, Japan

[21] Appl. No.: 930,658

[22] PCT Filed: Jul. 24, 1992

[86] PCT No.: PCT/JP92/00943

§ 371 Date: Oct. 2, 1992

§ 102(e) Date: Oct. 2, 1992

[87] PCT Pub. No.: WO93/01900

PCT Pub. Date: Feb. 4, 1993

[30] Foreign Application Priority Data

Jul. 24, 1991 [JP] Japan ..... 3-208660

[51] Int. Cl.[6] ..... B21B 1/28; B21B 37/00

[52] U.S. Cl. ..... 72/19; 72/234; 72/249

[58] Field of Search ..... 72/19, 21, 249, 234, 72/279, 289

[56] References Cited

U.S. PATENT DOCUMENTS

| | | | |
|---|---|---|---|
| 1,669,411 | 5/1928 | Clark | 72/443 |
| 3,457,747 | 7/1969 | Yeomans | 72/234 |
| 3,762,194 | 10/1973 | Maxwell | 72/19 |
| 3,823,593 | 7/1974 | Vydrin et al. | 72/205 |
| 4,079,609 | 3/1978 | Hodgskiss | 72/279 |
| 4,145,901 | 3/1979 | Imai et al. | 72/19 |
| 4,365,496 | 12/1982 | Shiozaki et al. | 72/249 |
| 4,566,299 | 1/1986 | Koyama et al. | 72/19 |

FOREIGN PATENT DOCUMENTS

| | | |
|---|---|---|
| 848033 | 7/1949 | Germany . |
| 1777111 | 4/1971 | Germany . |
| 0124032 | 6/1987 | Japan . |

*Primary Examiner*—Lowell A. Larson
*Assistant Examiner*—Thomas C. Schoeffler
*Attorney, Agent, or Firm*—Laurence R. Brown

[57] ABSTRACT

The present invention has an aim of providing a rolling mill and an operation method thereof for remarkably extending a roll life, optimizing a driving source and saving maintenance in the rolling mill. An optimum ratio for the number of driving rotations between driving rolls can be obtained by arranging rolls of predetermined shapes in a plurality of roll stands and adjusting the rolling reduction so as to obtain a required shape, then gripping the material to be formed with a clamping device, drawing the same for a required length without driving any of the rolls and determining the number of rotations or the like of each of the rolls. The driving force between each of driving rolls can be matched and optimized by driving each of the driving rolls at the optimum ratio for the number of driving rotations, which can remarkably extend the roll life, optimize the driving source and save maintenance in the rolling mill.

6 Claims, 7 Drawing Sheets

Fig, 3
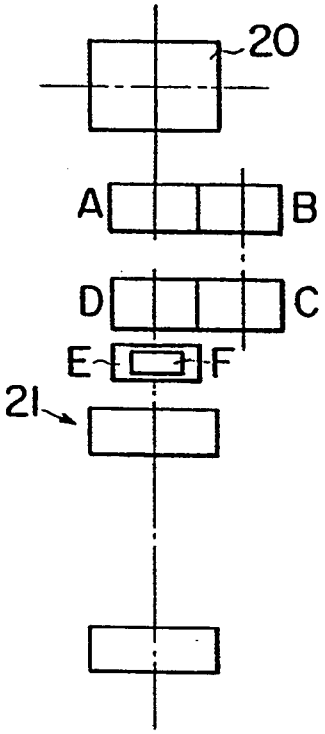

Fig, 4
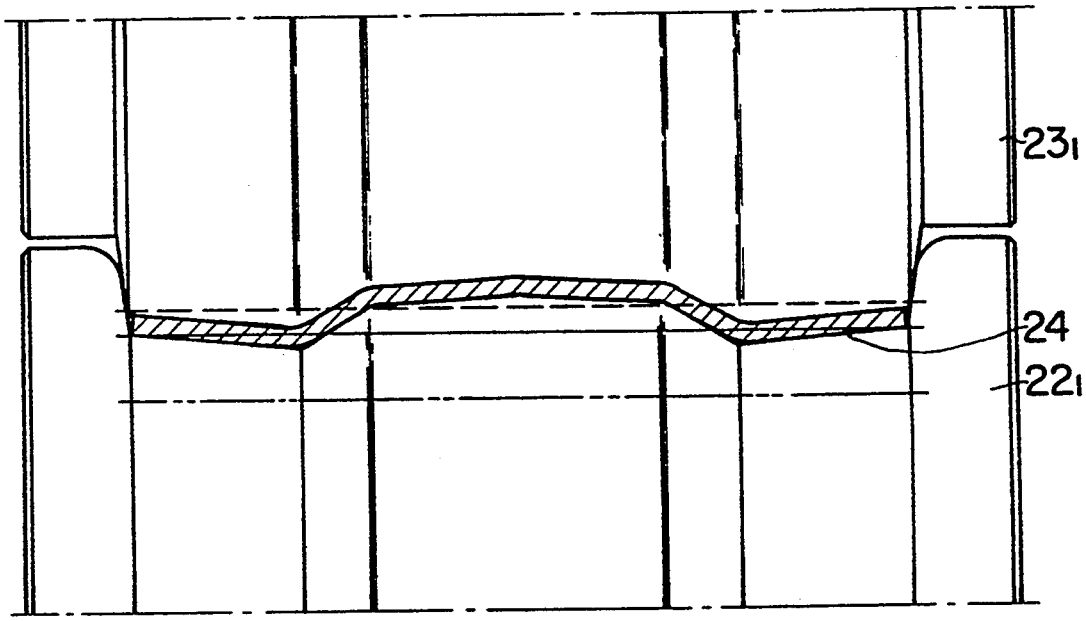
Fig, 5
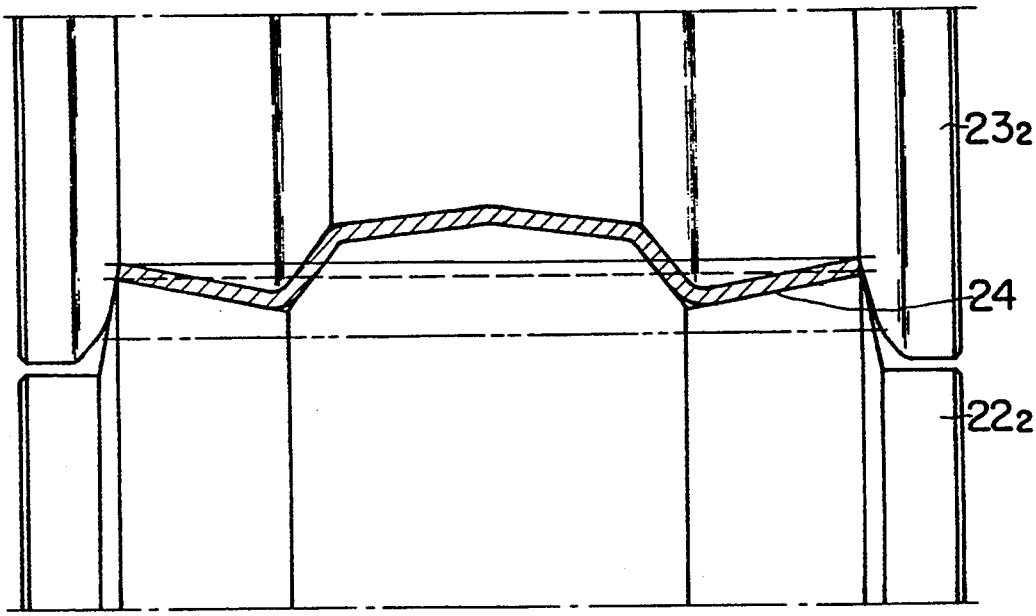

Fig,6
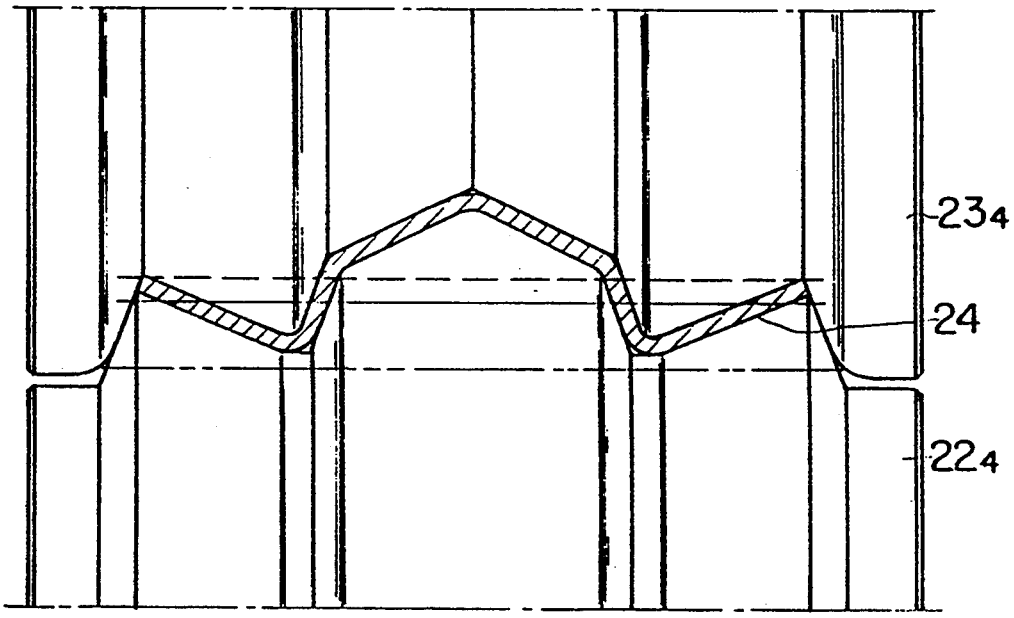
Fig,7
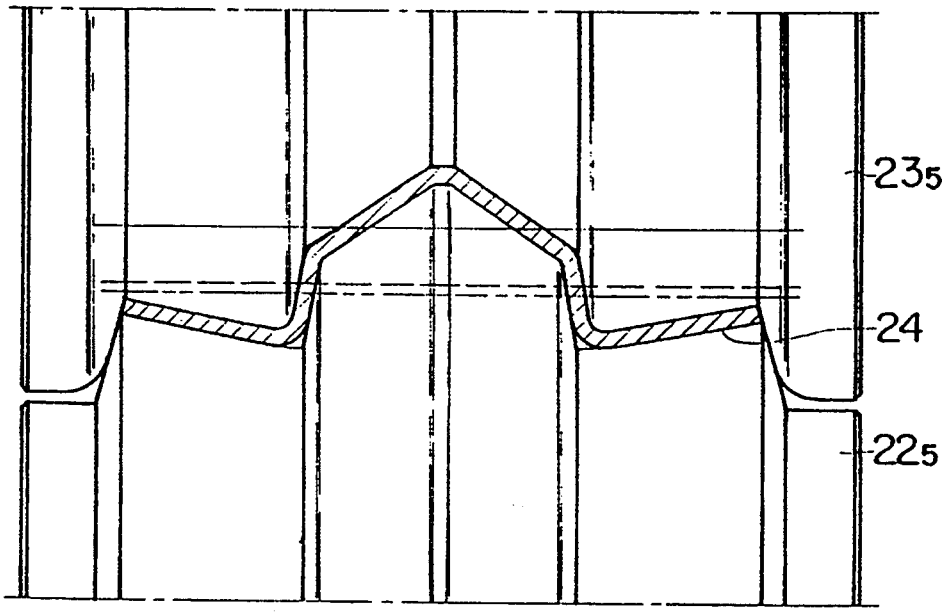

Fig, 8
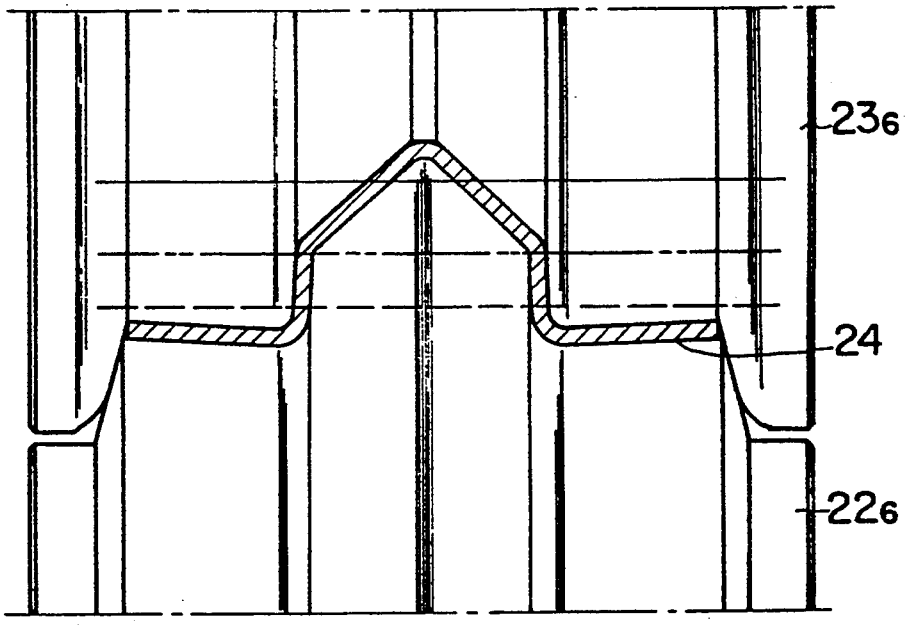
Fig, 9
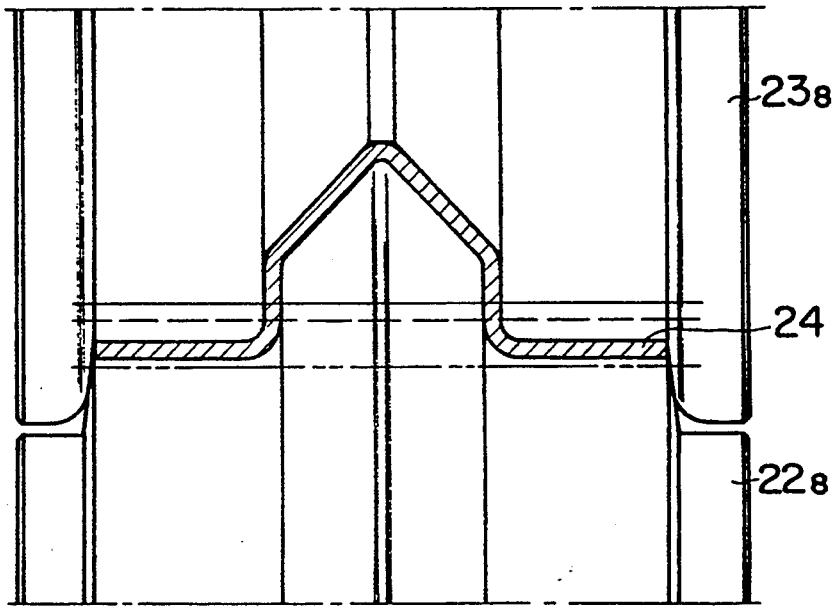

METHOD OF DETERMINING THE OPTIMUM RATIOS OF ROLL ROTATION SPEEDS IN A COLD ROLL FORMING MILL

TECHNICAL FIELD

The present invention concerns a method of determining the optimum ratio for the rotation speeds of a plurality of forming rolls used in a cold roll forming mill, a method of operating the roll forming mill based on the determined optimum value and a cold roll forming mill. It has a feature of attaining matching driving forces between a plurality of forming rolls during driving in the cold roll forming mill comprising a plurality of forming roll stands.

More specifically, the present invention comprises disposing forming rolls of predetermined shapes in a plurality of forming roll stands and controlling the rolling reduction so as to obtain a required shape, then gripping a material to be formed after the completion of formation by a clamping device, drawing it for a required length in an idle state without driving all rolls and determining the angle of rotation and the number of rotation of roll shafts in each of the forming roll stands in this state, thereby obtaining an optimum ratio for the rotation speeds between each of the driven forming roll stands and between upper and lower roll shafts relative to a certain standard roll shaft.

The present invention concerns a method of determining an optimum ratio for the rotation speeds in a cold roll forming machine, operation methods and a cold roll forming mill capable of matching driving forces in the entire rolling mill, for remarkably extending the life of rolls, optimizing a driving source such as saving electric power consumption and using a smaller size motor, and saving maintenance in the rolling mill.

BACKGROUND ART

Cold roll forming mills (hereinafter referred to as rolling mills) are generally used for forming metal materials for industrial products into various shapes. Relevant facilities for supplying raw materials are connected upstream and subsequent step facilities such as for drilling, cutting and bending are connected downstream of a roll forming line in which a plurality of forming roll stands (hereinafter referred to as roll stands) are disposed.

Formation of a plurality of different shapes in such a roll forming line has been greatly time and labor consuming such as requiring exchange of a number of roll stages, requiring forming rolls for exclusive use depending on the shapes, and requiring control for the rolling reduction force by adjusting the gap between the upper limit roll shaft.

In view of the above, a so-called cassette type cold roll forming mill has been put to practical use in which a plurality of roll stands are mounted on a sub-base coupled detachably to a common base. Exchange of the forming rolls and the controls described above are first completed off-line, where they are exchanged on each sub-base and connected with a driving source attached to the common base.

Further, for obtaining labor-saving, a plurality of such sub-bases are provided, forming rolls for exclusive use are provided for every shape to be formed and the sub-bases are exchanged in accordance with demand.

On the other hand, in the forming by a rolling mill, the shape of the forming rolls and the positions for disposing them on the line are determined depending on the shape required. The number of roll stands and the change and adjustment for the rolling reduction or the amendment and change of the roll shape has been conducted so that a required forming shape is obtained and the shape is stabilized while actually forming.

If a desired shape is obtained, for example, by a change and adjustment in rolling reduction, an appropriate change and adjustment for the rolling reduction can not always be attained. For instance, if the remainder of a rolling reduction ratio between each of the roll stands is not reached, then forced forming is conducted by the roll stand, or a roll stand adjacent thereto, whose rolling reduction is increased or decreased, which results in abrasion of rolls and damage to a driving system and, further, a desired shape can no longer be obtained because the roll is abraded and it again requires change and adjustment for the rolling reduction.

One of the objects of the so-called cassette type rolling mill for exchanging the sub-bases is to save labor by previously completing the exchange of the forming rolls or adjustment off-line. However, since there is no method for appropriately judging the adequacy for the change and the adjustment of the rolling reduction or the change of the roll shape it generally is done from experience of operation. If the balance of the rolling reduction between each of the roll stands is lost, for example, by the change and control of the rolling reduction ratio, abrasion of the forming rolls and degradation of the shaping property is caused, making it necessary to exchange the forming rolls in an early stage thus bringing about a problem that the merit inherent to this system can not be obtained.

In view of the foregoing present situation, it is an object of the present invention to provide a means for appropriately judging the adequacy for the change and the adjustment of the rolling reduction and the change of the roll shape, as well as to provide a means capable of remarkably extending the life of rolls, thereby reducing the electric power consumption and saving maintenance for the rolling mill. Thus, the invention further encompasses a rolling mill and operation methods therefor.

DISCLOSURE OF THE INVENTION

For taking the advantage of the cassette type and aiming at a rolling mill with less abrasion of rolls and less frequency of maintenance such as change and adjustment of rolling reduction, the present inventor has made various studies and has accomplished the present invention based on the following knowledge.

Since the roll shafts in each of the roll stands of a rolling mill are generally driven rotationally by a common motor, each of the shafts is driven at a certain ratio or at an identical rotation speed and, considering the state of contact between a forming roll and a raw material, all the surfaces in contact do not move at the forming speed of the raw material. A product feed radial position of a roll that moves with the forming speed of the raw material is assumed in the design so that ideal forming is applied as much as possible, but it is considered that this differs between each of the roll stands depending, for example, on the particular reduction state.

That is, assuming that the speed of the raw material to be formed is constant relative to each of the stands and each of the rolls and that the rotational speed of each of the roll shafts is constant, the product feed radial position of the roll (pass line) at which the speed of the raw material to be formed agrees with the rotational speed of the roll shaft often differs depending on the adjusted or changed rolling reduction in each of the stands and the roll shape.

Accordingly, if the roll shaft is driven at a constant rotational speed, it is considered that the set number of rotations is not always optimum but it can be considered that a roll not rotating at an optimum speed accelerates or decelerates the raw material to be formed due to excess friction in addition to forming.

By the way, it is imagined that an idler roll does not uniformly contact a raw material to be formed so that the non-uniform contact causes the roll to accelerate or decelerate the raw material to be formed. However, assuming the rolling rotation speed is determined at a certain position, the number of rotations of the idler roll is a number of rotations with least resistance in the state of rolling reduction, and most effective driving can be attained by diving at an identical speed with the number of rotations of the idler roll.

In view of the above, the optimum ratio for the number of rotations between each of the roll stands, and between upper and lower rolls in each of the roll stands, or the optimum ratio for the driving number of rotations to an arbitrary standard roll can be obtained by disposing rolls of predetermined shapes to a plurality of roll stands and adjusting the rolling reduction thereof so as to obtain a required shape while confirming that a predetermined forming shape is obtained, then gripping a material to be formed that leaves the final roll stand which is accomplished by a clamping device and drawing it for a required length in a free state without driving all of the rolls and determining, for example, the rotational angle and the number of rotations of the roll shafts for upper and lower rolls in each of the roll stands.

The determining method according to the present invention can determine the optimum rotation speed for individual rolls and, further, the optimum ratio for the number of roll rotations for each of upper and lower rolls among a plurality of roll stands in a roll forming mill capable of obtaining a required forming shape, that is, under the conditions that the present roll shape and the rolling reduction used in a plurality of roll stands are not varied.

In a rolling mill designed and controlled so as to obtain a desired forming shape, the roll shape and the rolling reduction set to each of the roll stands are not always set to best conditions.

However, an operation method according to the present invention measures the ratio for the optimum number of roll rotations and applies the result to control the number of rotations between upper and lower rolls in each of the roll stands and/or between upper and lower rolls in adjacent roll stands, or a roll forming mill is provided according to the present invention in which various speed changing means or driving source control means are disposed for applying such controls to drive at optimum rotational speeds the roll shafts in each of the roll stands. Accordingly, the invention can provide freedom from problems, for example, acceleration or deceleration to a material to be formed due to excess frictional force as in the prior art. Further the invention is capable of reducing the electric power consumption and remarkably reducing the occurrence of surface flaws due to slip or binding or abrasion of rolls.

Accordingly, the rolling mill applied with the operation method according to the present invention, for the driving system under a constant load, can attain an optimum ratio for the number of roll rotations in each of the driving roll stands; can extend the life of rolls; will make the adjustment of a rolling reduction ratio unnecessary for a long period of time and can attain a long working life with saving of maintenance.

Further, in a rolling mill having a plurality of roll stands, by making roll shafts of roll stands on a sub-base unit or by leaving an optional number of units free without driving and drawing the material to be formed by using a clamping device or by applying roll forming under driving of other roll stands, the optimum ratio for the number of roll rotations between upper and lower roll shafts of the roll stands set free can be determined and further, the optimum ratio for the number of roll rotations of roll stands set free can be determined.

Accordingly, in a rolling mill comprising a multistage construction, by dividing the plurality of roll stands with sub-base units or optional units and successively applying the determining method according to the present invention while making them free without driving on every unit, it is possible to determine the optimum ratio for the number of roll rotations between the roll stands for the entire number of stages and the optimum ratio for the number of roll rotations between upper and lower roll shafts in the roll stands at each of the stages.

Further, in the determining method according to the present invention when the ratio for the number of roll rotations is determined by dividing a plurality of roll stands by optional units while making them free without driving every unit, it is necessary to amend the ratio for the number of roll rotations of the divided unit and another divided unit adjacent to the first-mentioned divided unit. In such case the optimum ratio for the number of roll rotations throughout the entire number of stages can be determined in such a manner that the divided position is shifted to measure again the ratio for the number of roll rotations so that the thus measured ratio is amended together with the previously measured ratio for the number of roll rotations.

Furthermore, in a rolling mill having a plurality of roll stands, the raw material to be formed is separated in a plurality of sources, each having a desired length, and each source of raw material passes through each divided unit of roll stands, thereby measuring easily the ratio for the number of roll rotations. In this case, the measured ratio for the number of roll rotations is obtained in the state wherein the adjacent roll stands are made free, and, therefore, as above mentioned, the divided position is shifted to measure again the ratio for the number of roll rotations of the shifted unit of roll stands so as to amend the measured ratio for the number of roll rotations of the shifted roll stands together with the previously measured ratio for the number of roll rotations, thereby determining the optimum ratio for the number of roll rotations throughout the entire number of stages.

For the optimum ratio of the number of roll rotations between the roll stands according to the present invention which sets the roll stands for the entire number of stages free without driving, drawing, and measuring the material to be formed by using a clamp device, the elongation of the formed material per se has to be taken into consideration and it is preferable to conduct the drawing in such manner that an average longitudinal tension stress is applied to the entire sectional area of the material to be formed within a range of elastic deformation of the material.

Further, for obtaining the optimum ratio for the number of roll rotations between the free roll stands, which is measured by selecting the roll stands on the sub-base unit and setting them free while driving others, the elongation of the formed material per se and the difference of the forming speed between adjacent sub-base units have to be taken into consideration.

That is, a more optimized ratio for the number of roll rotations can be determined by amending the measured optimum ratio for the number of roll rotations with an amendment coefficient considering the elongation of the formed material per se, the entire forming speed and the difference of the forming speed on every measuring unit.

In the determining method according to the present invention, it is desirable to amend the resultant ratio for the number of rotations depending on various conditions of measurement such as the entire number of stages for the roll stands, the number of stages for measured units and the kind of the material to be formed.

As an effective means for obtaining such an amendment coefficient, there can be mentioned the electric power required for forming, for example, motor current. The formability and the forming amount in each of the roll stands can be evaluated by measuring the current throughout the entire number of stages and the current rating of the motor required for formation in each of the roll stands, and magnitude or ratio of the currents can be utilized for the amendment coefficient.

Further, as an effective means for obtaining other amendment coefficients, there can be mentioned a ratio for the difference of the shaping speed of the formed material between each of the roll stands, which can be used together with the elongation of the formed material per se and the current value described above.

Clamping Device

The method of determining the optimum ratio for the number of roll rotations according to the present invention features a drawing formed material which leaves the final roll stand and is completely formed for a required length while setting the rolls free without driving them in a roll flowing mill having disposing forming rolls so as to obtain a required shape by a known method, for example, as has been conducted so far, adjusting rolling reduction thereof, and confirming that a required shape is obtained, for which a clamping device for gripping the formed material completed with formation is necessary.

The clamping device can utilize such a construction, for example, in a case where the formed material is a pipe, as gripping the pipe with a cylindrical or tubular cylindrical member which is bisected and expansible in the diametrical direction at the inside and outside of the pipe, or by utilizing a known mandrel mill.

Further, in a case of a formed material having a usual open profile, it is possible to properly utilize a device having a split tubular member forming a required cross sectional shape such as a circular or rectangular shape by using an internal core mating the shape of the open cross sectional shape when it is inserted therein for gripping the entire cross sectional shape for clamping the formed material.

Measuring Means

In the present invention, as the measuring means for determining the number of rotations and the rotational angle of upper and lower rolls in each of the roll stands upon drawing a formed material for a required length or for different driving formations, known mechanical, optical or magnetic type rotational meters or various kinds of encoders can be selected properly and, further, a rotational speed meter using, for example, optical rotary encoder or magnetic sensor can also be used.

For instance, the measured number of rotations may be calculated as the ratio for the number of rotations between upper and lower rolls in each of the roll stands or between each of the roll stands of the rolling mill.

Further, as the most simple method for obtaining the ratio for the number of rotations, a rotational angle for each of the roll shafts upon drawing of a required length may be measured which can be calculated easily as a ratio for the number of rotations relative to an arbitrary standard roll shaft.

Operation Method and Rolling Mill

The operation method according to the present invention has a feature of applying the ratio for the number of rotations between upper and lower rolls in each of the roll stands or between each of roll stands obtained by the measurement as described above upon operation of the rolling means, and a means for giving the ratio for the number of rotations to each of the driven roll stands for controlled driving is properly selected depending on the construction of the rolling mill and the driving method.

Various constructions are adopted for the driving method of a roll flowing mill and, in a case of a mill having a driving motor on every roll stand, for instance, voltage and current may be controlled depending on the type of the motor and then it may be controlled so as to provide a required number of rotations respectively. Further, in a case of driving the entire system by a common motor or in a case of driving several stages by one motor, adjustment or modification can be applied to each of speed retarders interposed between the motor and the roll shaft, so as to change the gear ratio for obtaining a required number of rotations.

Further, in a case of placing roll stands for several stages on a sub-base and exchanging sub-bases depending on the shape of the formed material, adjustment after the exchange of the sub-bases is no longer required by disposing a speed changing means giving a previously measured optimum ratio for the number of rotations between upper and lower rolls in each of the roll stands and between each of the roll stands on the side of each driving roll stands.

For example, there can be adopted such a means as disengagably disposing an intermediate gear between a driving gear and a driven gear so as to be adjustable to provide a required ratio for the number of rotations depending on the number of teeth of a driven gear or intermediate gear.

The rolling mill according to the present invention has a feature of embodying the operation method described above to a rolling mill in which the speed changing means or the driving source control means may be adopted properly in accordance with the construction of the rolling mill.

Further, the optimum ratio for the number of roll rotations is previously measured so that each of the roll stands in the roll forming mill may be driven at an optimum ratio for the number of roll rotations. The measurement can, of course, be conducted in the roll forming mill, as well as it can be measured by other testing machines of a fundamentally identical structure having a structure that facilitates the change or adjustment of roll exchange adjustment for, inter-shaft distance or adjustment for rolling reduction thereby easily recognizing the amount of change, and being capable of measuring the number of roll shaft rotations and rolling reductions for each of the roll stands and having a calculator capable of directly calculating the obtained measured value as an optimum ratio for the number of rotations between each of the roll stands. The results of the measurement of the number of rotations and the conditions such as for rolling reduction which can be applied to the rolling mill.

Further, the inventor has already proposed a roll forming method and a pipe mill capable of manufacturing pipes of a plurality of different open diameters with no exchange of rolls (Japanese Patent Publication Hei 3-12975-7, U.S. Pat. No. 4,770,019), which has a feature of changing the abutting direction of a forming roll including a predetermined involute curve in a cross sectional shape to a material for changing the diameter to be formed. This changes the shape of the face of contact, thereby eliminating the requirement of roll exchange and improving the formability. When the present invention is applied to such a pipe mill, the driving system can be optimized, and improvement for the formability and increased life for the forming roll can be attained by controlling a driving motor on each roll stand so as to provide a required number of rotations upon changing the diameter.

BRIEF DESCRIPTION OF THE DRAWINGS

FIG. 3 is an explanatory block diagram showing a driving force transmission mechanism between a speed retarder and a roll shaft so as to compare the method of the present invention with the conventional one.

FIG. 4–FIG. 9 are explanatory views showing a relationship between upper and lower rolls and a material to be formed in each of roll stands, which illustrates the forming step of an open profile material according to the present invention.

BEST MODE OF CARRYING OUT THE INVENTION

EXAMPLE 1

Figure 1:
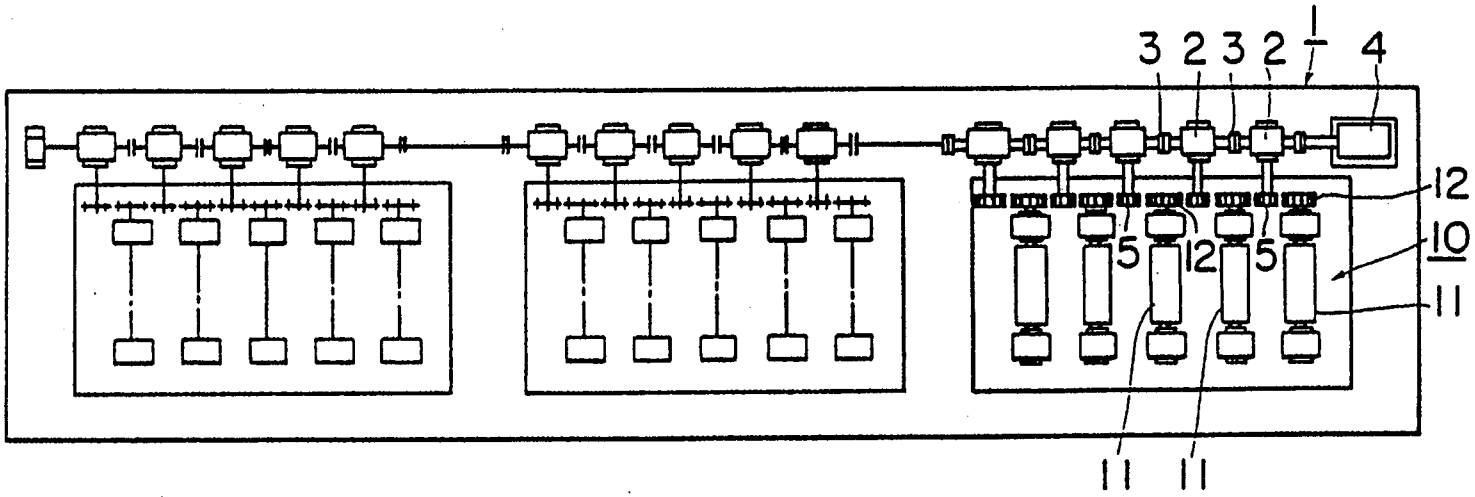
FIG. 1 is an explanatory top plan view showing the construction of an arrangement for a sub-base exchanging type rolling mill according to the present invention.

In a rolling mill showing in FIG. 1, five stages of roll stands 11 are placed in each of three sub-bases 10 and the number of sub-bases 10 is selected to constitute into a required number of stages, in which worm gear-type speed retarders 2 are arranged by the number of roll stands in the direction of the forming line on the side of a common base 1 are unified by way of counter shafts, and are connected with an electric motor 4 as a power source at the upstream end.

Figure 2:
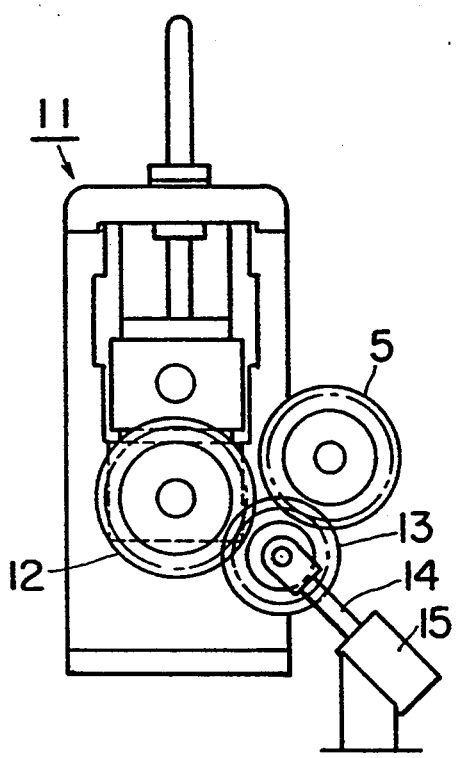
FIG. 2 is an explanatory side elevational view showing a driving force transmission mechanism between a speed retarder and a roll shaft in the rolling mill of FIG. 1.

The sub-base 10 is mounted on the side of the common base 1 and a driving shaft for each of the speed retarders 2 and the roll shaft of the roll stand 11 are usually connected by way of a coupling, and it is so adapted here that a driving shaft gear 5 of a speed retarder 2 and a roll shaft gear 12 are engaged by means of an intermediate gear 13 to transmit the driving force as shown in FIG. 2.

Further, as will be described later, the gear ratio between each of the driving shaft gears 5 and the intermediate gear 13 is identical, and the number of teeth for each of the roll shaft gears 12 is made different so as to obtain a predetermined gear ratio respectively.

The intermediate gear 13 is journalled to an extreme end of a piston rod 14 of a hydraulic cylinder 15 mounted on the common base 1, the intermediate gear 13 is made elevatable by telescopic motion of a hydraulic cylinder 15, so that it descends to release from engagement upon exchange of the sub-base 10, while it is engaged upon ascendant movement.

Forming rolls are arranged in each of the roll stands 11 and roll forming is conducted while adjusting the rolling reduction so as to obtain a required shape and, after the material to be formed leaves the final roll stand 11 and is completed with formation into a preferred shape. The intermediate gear 13 in each of the roll stands 11, being driven so far, is elevated to release, making the all roll stands free. The material to be formed which leaves the final roll stand, and is formed completely, has required length, and the ratio for the number of rotation of the roll shafts in each of the roll stands is measured by a rotational angle meter for the roll shaft previously disposed.

For drawing the material to be formed, a required cross sectional shape is formed by using an internal core to be inserted into an open cross sectional shape and aligning with the shape and a clamping device comprising a split type cylindrical member capable of gripping the entire cross sectional shape being pulled at a predetermined constant speed by a winch.

The predetermined ratio of the rotational number between the upper and lower rolls in each of the roll stands and between each of the roll stands measured were obtained, and the number of teeth of the roll shaft gears 12 described above is made different to provide predetermined gear ratios respectively so that a required driven roll stands are driven at that ratio.

Further, another sub-space 10 was provided depending on the shape of the material to be formed, and arrangements of the forming rolls, control for the rolling reduction, determination of the optimum ratio for the number of rotation of the roll shafts and the change of the roll shaft gear 15 as conducted by the above-mentioned method with the construction of the group of roll stands 11.

In this way, by providing separate sub-bases 10 respectively in accordance with the required shapes of a plurality of materials to be formed, estimating the shaping property of materials to be formed, estimating the shaping property of the resultant materials to be formed respectively and optimizing the number of rotations of roll shafts in each of the driving roll stands, it is possible to conduct roll forming by mounting sub-bases 10 for obtaining a required shape directly in the forming line in accordance with demand. By optimizing the number of driving rotations of the driving roll shafts, abrasion of the forming rolls is remarkably decreased, the formability was improved to reduce the occurrence of product flaws, maintenance such as control for the rolling reduction was no more required for a long period of time and products having constant shaping property could always be obtained stably by merely replacing one subbase with another required one.

Further, since the number of rotations of the roll shafts was optimized, the electric motor 4, the speed retarder 2 and the driving system for each of the gears, there is no portion on which an overload is exerted and maintenance was no longer required for a long period of time.

EXAMPLE 2

For obtaining an open profile product having a cross sectional shape with a central portion being angled, that is, a rail shaped product of a formed material 24 put between upper and lower forming rolls 22*n* and 23*n* as shown in FIG. 9, from a zinc-plated steel sheet of 3.2 mm thickness. A rolling mill for roll forming a strip steel by a 8-height roll stand, rolls of predetermined shapes were disposed in each of the roll stands, and the rolling reduction or the like was controlled so as to obtain a required shape. The operation conditions in the conventional operation methods, in particular the electric motor current, the number of rotations for each of the roll shafts and the forming speed in operation were measured.

Further, the optimum ratio for the number of roll rotations in accordance with the present invention was determined and the operation method according to the present invention was conducted while changing the gear ratio of the speed retarder in each of the roll stands, in which the electric motor current, the number of rotations for each of the roll shafts and the forming speed were measured.

In practicing the operation method according to the present invention, the electric motor current, and the rotational speed for each of the roll shafts and the forming speed were measured in a case of a comparative example in which the roll shaft in each of the roll stands was not driven.

At first, rolls of predetermined shapes were arranged in each of the roll stands so as to obtain a predetermined forming shape. There are shown upper and lower forming rolls, i.e., for the first stage in FIG. 4, for the second stage in FIG. 5, for the fourth stage in FIG. 6, for the fifth stage in FIG. 7, for the sixth stage in FIG. 8 and for the eighth stage in FIG. 9. The third stage and seventh stage are not illustrated.

Driving for each of the roll shafts has the same constitution as in Example 1 of transmitting a driving force by way of a speed retarder with a worm gear by an electric motor, in which a gear box is interposed between a speed retarder 20 and a roll stand gear 21 in each of the roll stands as shown in FIG. 3, so that the gear ratio can be changed. That is, it comprises a mechanism of transmitting a driving force from the speed retarder 20, from a gear A to a gear B meshing therewith, from a gear C coaxial with the gear B to a gear D meshing therewith, from a gear E (lower shaft) coaxial with the gear D to a gear F (upper shaft) meshing therewith.

The specifications for the electric motor are 37 kw of power, 194.8 A of rated current, 850 rpm rotational speed and 1/31 of reduction ratio of the speed retarder.

The gear ratio in the gear box by the conventional operation method is naturally at an equal speed ratio of 1:1 both for the upper and lower shafts between each of the roll stands as shown in Table 1, and the gear ratio is set in accordance, for example, with the outer diameter of rolls mounted between the upper and lower roll shafts in each of the roll stands.

The results of measurement for the operation conditions by the conventional operation method are as shown in Tables 2, 3, and 4. In comparison with the present invention in Table 2, comparison is made while converting the forming speed to 13.5 m/min which is the same as in the present invention.

TABLE 1

| | Gear setting ratio (conventional method) | | | | | | | |
|---|---|---|---|---|---|---|---|---|
| | No.1 | No.2 | No.3 | No.4 | No.5 | No.6 | No.7 | No.8 |
| C | 1 | 1 | 1 | 1 | 1 | 1 | not-driven | 1 |
| D | 1 | 1 | 1 | 1 | 1 | 1 | — | 1 |
| E (upper shaft) | 42 | 42 | 42 | 42 | 42 | 42 | 42 | 42 |
| F (lower shaft) | 24 | 24 | 24 | 24 | 24 | 24 | 24 | 24 |

TABLE 2

| | Conventional method | Comparison with the present invention |
|---|---|---|
| Forming speed | 14.5 m/min | — |
| Motor r.p.m | 840 rpm | — |
| Non-load current value | 22 A | — |
| Load current value | 118 A | 122.1% |
| Current value required for forming | 96 A | 131.4% |

TABLE 3

| | Number of rotations and feed diameter (Conventional Device) | | | | | | | |
|---|---|---|---|---|---|---|---|---|
| | No.1 | No.2 | No.3 | No.4 | No.5 | No.6 | No.7 | No.8 |
| lower shaft rpm | 22.20 | 22.20 | 22.20 | 22.20 | 22.20 | 22.20 | not-driven | 22.20 |
| Product feed diameter | 208.0 | 108.0 | 208.0 | 208.0 | 208.0 | 208.0 | — | 208.0 |
| upper shaft rpm | 38.85 | 38.85 | 38.85 | 38.85 | 38.85 | 38.85 | not-driven | 38.85 |
| Product feed diameter | 118.8 | 118.8 | 118.8 | 118.8 | 118.8 | 118.8 | — | 118.8 |

TABLE 4

| | Current value (Conventional device) | | | | | | | |
|---|---|---|---|---|---|---|---|---|
| | All stage pass | No.2 — No.8 pass | No.3 — No.8 pass | No.4 — No.8 pass | No.5 — No.8 pass | No.6 — No.8 pass | No.7 — No.8 pass | No.8 pass |
| Each current value | 11.8 | 106 | 83 | 72 | 56 | 49 | 32 | 28 |
| Current value per one stage | 12 | 23 | 11 | 16 | 7 | 18 | 9 | 4 |

Then, the rotational angle for the roll shafts in each of the forming roll stands was measured when all the roll shafts in the mill were set free with no driving, gripping the formed material completed with formation by a clamping device and it was drawn by a required length, in which the optimum ratio for the number of rotations of all shafts was measured with reference to the lower roll shaft at the first stage.

A rolling mill for practicing the operation method according to the present invention was manufactured while changing to the setting gear ratio shown in Table 5 so as to attain the optimum ratio for the number of rotations of all roll shafts and the results of the measurement for the operation conditions, etc. when conducting the roll forming as shown in Tables 6, 7 and 8.

TABLE 5

| | Gear setting (this invention) | | | | | | | |
|---|---|---|---|---|---|---|---|---|
| | No.1 | No.2 | No.3 | No.4 | No.5 | No.6 | No.7 | No.8 |
| C | 42 | 42 | 42 | 42 | 42 | 42 | not-driven | 42 |
| D | 42 | 42 | 41 | 40 | 42 | 43 | — | 38 |
| E (upper shaft) | 40 | 38 | 36 | 36 | 36 | 35 | 40 | 37 |
| F (lower shaft) | 26 | 28 | 30 | 31 | 31 | 32 | 40 | 37 |

TABLE 6

| | Method of the invention | Comparison with the Conventional method |
|---|---|---|
| Forming speed | 13.5 m/min | — |
| Motor r.p.m | 840 rpm | — |
| Non-load current value | 22 A | — |
| Load current value | 90 A | 81.9% |
| Current value required for forming | 68 A | 77.7% |

TABLE 7

| | Number of rotations and feed diameter (This invention) | | | | | | | |
|---|---|---|---|---|---|---|---|---|
| | No.1 | No.2 | No.3 | No.4 | No.5 | No.6 | No.7 | No.8 |
| lower shaft rpm | 22.20 | 22.20 | 23.28 | 24.42 | 22.20 | 21.17 | not-driven | 26.87 |
| Product feed diameter | 193.6 | 193.6 | 184.6 | 176.0 | 193.6 | 203.1 | | 159.9 |
| upper shaft rpm | 34.15 | 30.13 | 27.94 | 28.86 | 25.78 | 23.15 | — driven | 22.52 |
| Product feed diameter | 125.8 | 142.7 | 153.8 | 151.6 | 166.7 | 185.7 | — | 190.9 |

TABLE 8

| | Current value (This invention) | | | | | | | |
|---|---|---|---|---|---|---|---|---|
| | All stage pass | No.2 — No.8 pass | No.3 — No.8 pass | No.4 — No.8 pass | No.5 — No.8 pass | No.6 — No.8 pass | No.7 — No.8 pass | No.8 pass |
| Each current value | 90 | 72 | 55 | 50 | 42 | 38 | 31 | 26 |
| Current value per one stage | 18 | 18 | 5 | 8 | 4 | 7 | 5 | 4 |

After practicing the present invention described above, the roll forming was conducted without driving the upper shaft roll in each of the roll stands for comparison. The setting gear ratio is the same as that in the present invention except for not driving the upper shaft roll. The results of the measurement for the operation conditions, etc. by the comparison method are as shown in Tables 9, 10 and 11. Upon comparison with the present invention in Table 9, comparison is made while converting the forming speed to 13.3 m/rain which is the same as that in the present invention.

TABLE 9

| | Comparative method | Comparison with the this invention |
|---|---|---|
| Forming speed | 11.7 m/min | — |
| Motor r.p.m | 840 rpm | — |
| Non-load current value | 22 A | — |
| Load current value | 84 A | 107.7% |
| Current value required for forming | 62 A | 105.2% |

TABLE 10

| | Number of rotations and feed diameter (Comparative Example) | | | | | | | |
|---|---|---|---|---|---|---|---|---|
| | No.1 | No.2 | No.3 | No.4 | No.5 | No.6 | No.7 | No.8 |
| lower shaft rpm | 22.20 | 22.20 | 23.28 | 24.42 | 22.20 | 21.17 | not-driven | 26.87 |
| Product feed diameter | 167.8 | 167.8 | 160.0 | 152.5 | 167.8 | 176.0 | | 138.6 |

TABLE 11

| | Current value (Comparative Example) | | | | | | | |
|---|---|---|---|---|---|---|---|---|
| | All stage pass | No.2 — No.8 pass | No.3 — No.8 pass | No.4 — No.8 pass | No.5 — No.8 pass | No.6 — No.8 pass | No.7 — No.8 pass | No.8 pass |
| Each current value | 85 | 70 | 65 | 48 | 42 | 35 | 31 | 26 |
| Current value per one stage | 15 | 5 | 17 | 6 | 7 | 4 | 5 | 4 |

As apparent from the results of measurement described above, in the operation method according to the present invention of determining the optimum ratio for the number of driving rotation between each of the driving roll stands and applying the same to driving control, the motor current required for forming is remarkably reduced, energy can be utilized effectively with less loss for roll forming an identical shape and less burden is applied to the forming rolls.

Further, referring to the product feed diameter (unit: mm) of upper and lower Shafts in each of the roll stands, that is, the roll radius position is viewed from the roll shaft at which the velocity of each of upper and lower rolls is made equal with that of the material is opened greatly in the conventional case, whereas, as shown in FIGS. 4 to 9 wherein a position at which the speed of the material is equal to that of the upper rolls is shown by a broken line and a position at which the speed of the material is equal to that of the lower rolls is shown by solid line, the gap between both of them is relatively narrow in the present invention and it can be found that the formed material is fed smoothly. From FIGS. 4 to 9 wherein a position at which the speed of the material is equal to that of the upper rolls which are idling is shown by a dot and dash line it can be seen that the roll radius position between the upper and lower rolls is greatly opened.

Further, the comparative example is for a case where all of upper rolls in each of the driving stands are set idle in the operation conditions of the present invention, in which the forming speed is greatly reduced and the motor current required for forming is increased as compared with the present invention.

It is not appropriate to apply, to this example, the common knowledge of the skilled in the art that the speed of the upper roll tends to become equal with that of the material to provide good forming property, if all of the upper rolls set idle while driving only the lower shafts. The present inventor has found that it is indispensable for matching and optimizing driving to positively drive each of the upper and lower roll shafts at an optimum speed.

In the foregoing examples, the optimum ratio for the number of the rotations obtained by the determining method according to the present invention is applied without amendment and it can be seen that the formability is improved outstandingly as compared with that in the conventional example.

Then, when the present inventor corrected and amended the optimum ratio for the number of driving rotations between each of the roll stands was obtained, based on the elongation of the formed material through all the stage of roll stands or on every stages, the forming speed and the speed difference through all the stages of roll stands or on each stage, or a motor current through all the stages of roll stands or on each stage, an effect of reducing the motor current required for forming by several percent as compared with that of the examples described above in any of the amendments, either alone or in combination, for each of the amendment terms of the elongation for the formed material, difference in the forming speed and the current value.

When the roll forming was practiced after amending the roll shape and controlling the rolling reduction while assuming that there is a problem for the shape of the forming roll in a roll stand in which the forming roll shape or the current value required for forming is greater than the mean value in the roll stand to be applied with the amendment described above, there was an effect of reducing the current value required for forming further by several percent as compared with the case of conducting the amendment.

That is, the optimum ratio for the number of driving rotations between each of the roll stands according to the present invention is not only applied to the operation method, but it can also provide an appropriate judgement for the distribution of the forming amount and the forming roll shape by repeating the measurement for the optimum ratio of the number of driving rotations and the amendment for the forming conditions as described above.

EXAMPLE 3.

Figure 10:
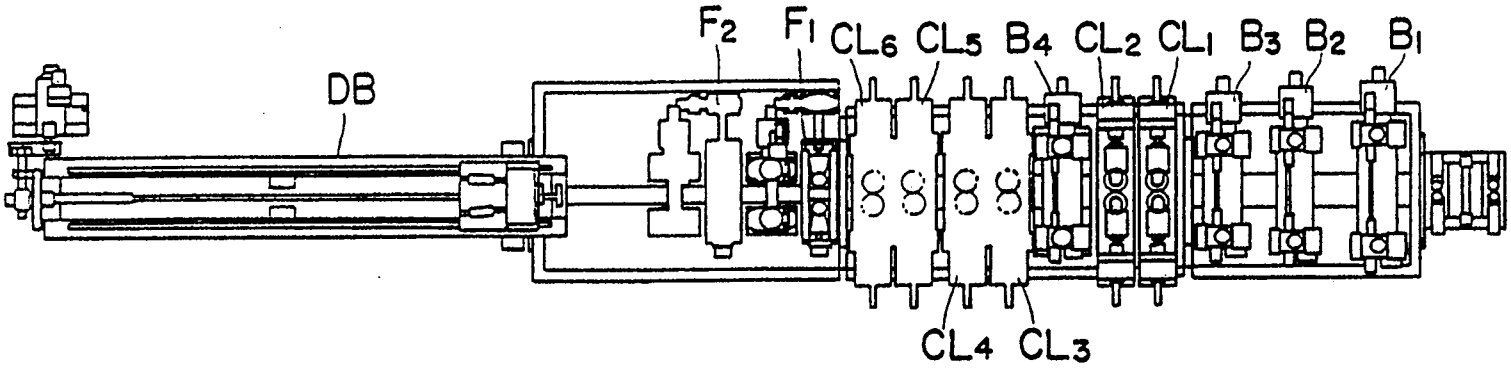
FIG. 10 is an explanatory upper plan view illustrating the construction of an arrangement of a test bench for production of pipes according to the present invention.

A rolling mill shown in FIG. 10 as a pipe-manufacturing test bench according to the present invention and it illustrates an example in which it is applied to a pipe mill capable of manufacturing pipes of diameters in a required range without exchanging rolls as previously proposed by the present inventor (in Japanese Patent Publication Hei 3-12795-7, U.S. Pat. No. 4,770,019). Welding facilities are not illustrated in the drawing.

From the upper stream of the pipe mill, that is, right side of FIG. 3, a group of breakdown roll stands B1, B2, B3 are arranged, a breakdown roll stand B4 is arranged by way of a cluster roll stands CL1, CL2 and fin pass roll stands F1 and F2 are arranged further to the down stream of four clusters roll stands CL3, CL4, CL5 and CL6.

Forming rolls depending on the forming stages are arranged in each of the roll stands respectively, in which various kinds of forming rolls such as breakdown rolls and the cluster rolls used have cross sectional curves comprising involute curves based on a predetermined polygonal shape so as to align the curves for required portions of a strip steel in each of roll flowers of steel pipes with various outer diameters in the forming region although not illustrated, and movable bearing portions are provided so as to move and rotate the bearing portion to linear or arcuate direction of the blank by means of a hydraulic cylinder or a hydraulic motor equipped with a lock so that the abutting angle and the position of the forming rolls to the forming blank may be changed depending on various outer diameters.

For controlling the abutting angle and the position of the forming rolls to the formed material as previously set, various kinds of the hydraulic actuators are controlled by a calculator based on signals from a positional sensor disposed to the bearing portion.

Further, a load cell for measuring the rolling reduction is disposed, in addition to the rotational meter for measuring the number of rotations of the roll shafts, to each of the roll stands, and the output therefrom is inputted to the memory device for the calculator.

Further, driving motors are disposed individually to required roll stands such as a group of breakdown roll stands requiring driving, and a controller for adjusting the driving force by the control for the voltage or the current is incorporated into the calculator.

In the pipe mill with such a construction, roll forming was at first conducted while adjusting the rolling reduction by changing the abutting angle and the position of the forming roll in each of the roll stands to the forming material so as to obtain a pipe of a required diameter and, after the shaping property of the pipe leaving the final roll stand and completed with the forming is made satisfactory, power supply to the motor for each of the roll stands under driving is interrupted to make all the roll stands free, and the tube leaving the final rolling stands and completed with the formation was drawn by a draw bench DB at a required constant speed, to measure the number of rotations for roll shafts in each of the roll shafts.

By previously programming such that each of driving motors is controlled for driving at an optimum ratio for the number of driving rotations based on the number of rotations for the roll shafts in each of the roll stands previously measured by the calculator, the number of rotations for the produced pipe and the roll shafts was measured on every required diameter and the date for the rolling reduction in each of the roll stands and the number of rotations for the roll stands on every diameter were stored, by which the motor can afterward be driven under control at an optimum ratio for the rotational speed between the driving roll stands automatically depending on the diameter.

As a result, abrasion of the forming rolls was remarkably reduced, the forming property was improved to reduce the occurrence of product flaws, etc., maintenance such as for the adjustment of the rolling reduction was no more required for a long period of time and the durability of the entire pipe mill was remarkably improved.

Industrial Applicability

In accordance with the present invention, rolls of predetermined shapes are arranged in a plurality of roll stands and rolling reduction thereof are adjusted so as to obtain a required shape, formed material completed with forming is gripped by a clamp device after obtaining a predetermined formability, the material is drawn by a required length without driving any of the rolls and determining the number of rotations, etc. in each of the roll stands, by which the optimum ratio for the number of driving rotations, can be obtained between each of the driving roll stands, the driving force between each of the roll stands can be matched and optimized by driving each of the driving roll stands at the optimum ratio for the number of driving rotations, which can attain the maintenance free of the rolling mill such as reduction of occurrence for the surface flaws due to slip or biting, remarkable elongation or extension of the roll life, reduction of aging change and elimination for the requirement of fine adjustment of the rolling reduction for a long period of time, which has been indispensable so far, as well as driving force can be optimized, for example, in that a smaller motor as compared with the usual case can be used.

Further, in accordance with the present invention, since the measurement for the optimum ratio for the number of driving operations is easy and the results of the measurement therefor can easily be applied also to existent rolling mills, the driving force for all of the rolling mills can be matched and optimized.

I claim:

1. The method of operating a cold roll forming mill having a sequence of powered roll stands to shape a sheet of material of substantially constant thickness into a desired shape by passing through upper and lower shaping rolls at each of the roll stands, comprising the steps of:

supplying the sequence of powered roll stands with means for variably controlling the speeds of the upper and lower rolls, determining a set of optimized roll speed ratios between the upper and lower rolls of each roll stand for attaining appropriate changes of shape of the sheet of material without accelerating and decelerating movement of the sheet of material through the rolls, and adjusting the roll speed ratios between the upper and lower rolls at each of the roll stands to the set of optimized roll speed ratios, and maintaining the adjusted roll speed ratios during passage of the sheet of material through the rolls.

2. The method of claim 1 in a mill powered by a plurality of electric motors wherein the adjusting step further comprises adjustment of the different speed ratios for minimizing the power consumption of the electric motors.

3. The method of operation of a cold roll forming mill having multiple roll stands for forming a sheet material of substantially constant thickness into a shape, comprising the steps of:

arranging the cold roll forming mill into a sequence of motor driven roll stands for forming the sheet material into a desired shape by movement through upper and lower rolls, moving a length of sheet material through the sequence of roll stands to attain said desired shape without powering the motor driven roll stands, establishing ratios between speeds of upper and lower roll shafts in each roll stand, and adjusting the upper and lower roll shaft speeds of the roll forming mill when motor driven to conform with the established ratios.

4. The method defined in claim 3 further comprising the steps of:

determining the elongation of the sheet material in the mill, and adjusting the motor driven shaft speeds as a function of the elongation.

5. The method defined in claim 3 wherein the step of adjusting the roll shaft speeds in a mill having a plurality of motors for driving the mill further comprises:

establishing the motor power drive required in the respective motors as a function of said established ratios.

6. The method defined in claim 3 wherein the step of moving the material through the rolls without powering the rolls further comprises:

clamping the sheet material to powered moving means, and moving the sheet material through the unpowered roll stands at a constant speed.

* * * * *